US005716181A

United States Patent [19]

Ebel

[11] Patent Number: 5,716,181

[45] Date of Patent: Feb. 10, 1998

[54] ONE PIECE SELF-BINDING SYSTEM FOR BINDING DOCUMENTS

[76] Inventor: Brian J. Ebel, P.O. Box 13147, Santa Rita, Guam, 96915

[21] Appl. No.: 599,516

[22] Filed: Jan. 26, 1996

[51] Int. Cl.[6] ..... B42D 1/00

[52] U.S. Cl. ..... 412/1; 412/8

[58] Field of Search ..... 281/21.1, 29, 15.1, 281/23, 19.1; 412/8, 1, 901, 37, 4–6, 19, 20, 900, 33, 21, 34; 156/908

[56] References Cited

U.S. PATENT DOCUMENTS 4,928,995 5/1990 Pickering et al. ..... 281/29
4,934,738 6/1990 Colonna ..... 281/29 X
5,061,139 10/1991 Zoltner .

FOREIGN PATENT DOCUMENTS 1546650 11/1968 France ..... 281/45
61-87983 6/1986 Japan .
758012 9/1956 United Kingdom ..... 281/45

*Primary Examiner*—Frances Han
*Attorney, Agent, or Firm*—Young & Thompson

[57] ABSTRACT

Self binding system for home use that utilizes a spring binding to clamp pages into a bound book. A retaining piece is used to hold the spring binding open until the pages are in place. Once the retaining piece is removed the spring binding clamps the pages in the book cover.

9 Claims, 1 Drawing Sheet

ONE PIECE SELF-BINDING SYSTEM FOR BINDING DOCUMENTS

BACKGROUND-FIELD OF INVENTION

This invention relates to the binding of bound or unbound books or repair of old books, and specifically to improvements in the manner and ease in which book covers are secured to the pages of a book.

BACKGROUND-DESCRIPTION OF PRIOR ART

The binding of books is an age old art, dating to before the invention of the printing press, and today, many techniques are used to temporarily or permanently secure pages as a book. Many of these techniques are either suited for high volume runs of a single book or are costly and labor intensive for the binding of one off books or the repair of old books. A defined need exists for an inexpensive means for individuals or institutions to bind single books or repair old books.

Traditionally, books are bound by the use of adhesive applied to the pages and the spine of the book cover. This method is still the method of choice for large runs of a single book. However, it requires a great deal of skill to produce a quality book and it is highly labor intensive to produce a single book or to repair an old book. A more economic binding method used for the binding or repair of books, is a combination of staples and adhesive. The pages are stapled between two release sheets that have adhesive on the two outer sides. These pages are then placed in a book cover and the adhesive holds the pages in the book. The release sheets form the inside surface of the book cover, covering the cardboard of the cover boards. This method also requires skill and is labor intensive. Other methods of binding books have also been developed using a combination of fibrous materials, rivets, staples and adhesives, but most share the limitations as outlined above along with the cost of preparing pages for binding.

In a departure from the more traditional methods, Elbe Products, 649 Alden St., Fall River, Mass., produces a book binding that is opened and closed by bending the covers backwards. The covers are attached to a mechanism that squeezes the pages when the covers are released. The binding of this method is not permanent and will release the pages whenever the covers are bent backwards, and the bindings become less secure with use.

Another binding method disclosed in U.S. Pat. No. 5,061,139 to Zoltner, 1991 Oct. 29, uses a metal U-shaped channel bound to a book cover. The pages are placed in the channel and a machine is used to crimp the metal channel against the pages and secure them in place. The machine for this method is costly and not economic for use other than in a commercial or institutional setting.

OBJECTS AND ADVANTAGES

Accordingly, several objects and advantages of my binding system are that it provides a simple, fast, cost effective means of binding books, which does not require special skill or use of any external equipment. To bind a book, one simply places the pages in a book cover and spine and then removes a binding spine retainer by pulling an attached pull ring. The simplicity of use allows virtually anyone to bind their own books in just minutes. This binding system provides for a cost effective means to repair old books and it provides a means to bind a soft cover book in a hard book cover to increase its durability.

Further objectives and advantages of my binding system will become apparent from a consideration of the drawings and ensuing description.

DRAWING FIGURES

REFERENCE NUMERALS IN DRAWINGS

10 - Book Cover and Spine
11 - Spring Binding Spine
12 - Binding Spine Retainer
13 - Retainer Pull Ring
14 - Spine
15 - Cloth or Paper Cover
16 - Hard Cover Boards
17 - Release Sheets
18 - Ring Securing Bend
19 - Bound Pages
20 - Bound Book
30 - Spine Retainer Assembly

DESCRIPTION-FIGS. 1 TO 4

Figure 1:
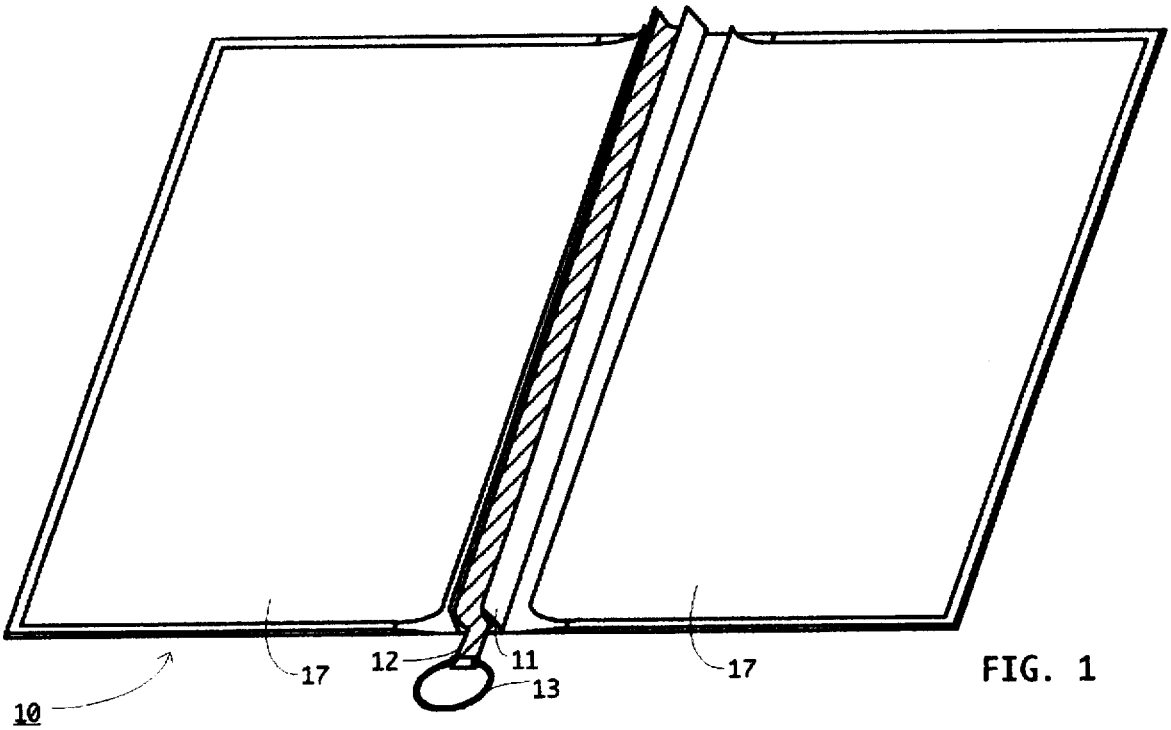
FIG. 1 is a perspective view of the book cover and spine laid flat (before binding).
Figure 2:
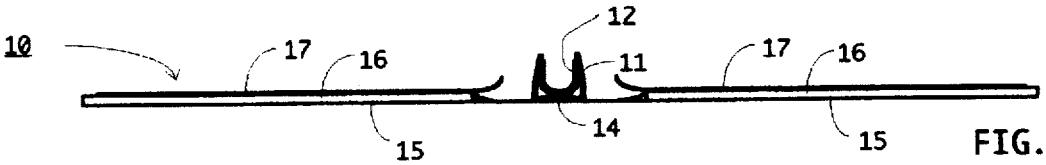
FIG. 2 is an end view of the book cover in FIG. 1 (Retainer Pull Ring not shown).
Figure 3:
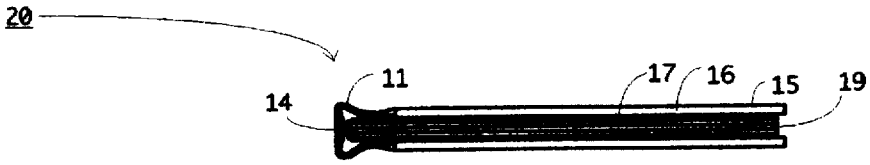
FIG. 3 is an end view of the bound book and pages (after binding).
Figure 4:
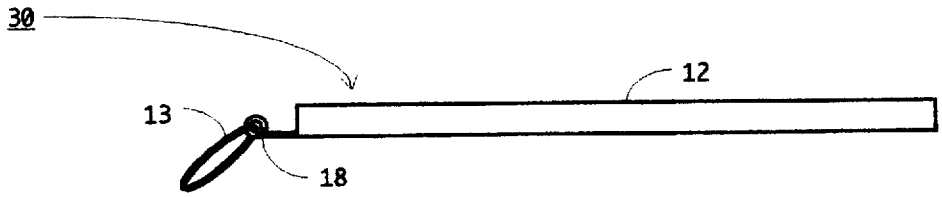
FIG. 4 is a side view of the removed Binding Spine Retainer Assembly (after binding).

A typical embodiment of the self binding system of the present invention is illustrated in FIG. 1 (perspective view) and FIG. 2 (end view). The book cover and spine 10 shown in FIG. 1 and FIG. 2 is formed by two hard cover boards 16 bonded to a cloth or paper cover 15. The cover wraps over both hard cover boards, which are spaced apart, forming a flexible spine 14. A spring binding spine 11 is bound along the spine of the book. This spring binding spine is formed of a material that with elastic deformation can produce enough pressure to capture the pages in a book, with the strength of metal being preferable. Before the binding, a binding spine retainer 12 is positioned in the spring binding spine 11 as shown in FIG. 1 and FIG. 2. This binding spine retainer holds the spring binding spine open either as a rigid retainer or by being a spring counter to the spring binding spine. The binding spine retainer 12 is connected to a retainer pull ring 13 by a ring securing bend 18 in the binding spine retainer 12 as shown in FIG. 4. For clarity, the retainer pull ring 13 is not shown in FIG. 2. Once the book is bound, the binding spine retainer assembly 30 is removed from the book cover and spine 10. The completed bound book 20 with pages 19 bound inside is shown in FIG. 3. FIG. 1 through FIG. 4 show a relatively small book, but this system is suitable for binding much larger books.

OPERATION

The manner of using the self-binding system to make a bound book 20 is accomplished in three simple steps. First, one must select the proper sized book cover and spine 10 for the pages that are to be bound. This selection is based on two considerations, 1) the total thickness of all the pages, and 2) the height and width of the pages. Second, the pages are jogged, placed in the spring binding spine 11 of the book cover and spine 10 along with the release sheets 17, and the book is then shut to hold the pages in place. Third, the book is held in one hand and the retainer pull ring 13 is grasped in the other hand and gently pulled out of the spring binding spine 11. This action pulls the entire binding spine retainer assembly 30 from the book cover and spine 10, allowing the spring binding spine to close down on the pages, creating a bound book 20.

SUMMARY, RAMIFICATIONS, AND SCOPE

The reader will see that the self binding system of the invention provides an easy to use system for the binding of documents into bound books. It provides an easy, cost effective method for binding one of a kind bound books, without the use of external equipment. It also provides institutions an effective method for repairing books that have been damaged by use or making soft bound books more durable by adding a hard bound cover. While my above description contains many specifications, these should not be construed as limitations on the scope of the invention, but rather as an exemplification of one preferred embodiment thereof. Many other variations are possible. For example, this system could be used to bind photo holding plastic sheets into a photo album, to hold fabric samples to make a sample book, or to bind awards and certificates into a special keepsake. Accordingly, the scope of the invention should be determined not by the embodiment illustrated, but by the appended claims and their equivalents.

I claim:

1. A method of forming a bound book comprising the steps of:

a) providing a plurality of pages;

b) providing a front and back cover;

c) providing a flexible spine attached to said covers;

d) providing a spring clamp of predetermined size and tension;

e) providing a slotted member placed inside said spring clamp of sufficient size to retain the spring clamp in an open position full length of said spring clamp;

f) securing said spring clamp to the length of said spine with means selected from the group of adhesives, rivets, meldings, staples, screws, and slots;

g) placing said plurality of pages within said slotted member contained within said spring clamp;

h) removing said slotted member in order to secure the pages between said covers by the pressure of said spring clamp.

2. The method of claim 1, further including the step of providing said spring clamp and said slotted member in the form of metal.

3. The method of claim 1, wherein said pages are secured to said spring clamp, spine and covers independent of external equipment.

4. A method for binding pages of a book to a hard or soft book cover comprising the steps of:

providing a hard or soft book cover that includes a spring spine secured to the length of the spine and which is held in an open position full length of said spring spine by a slotted member; inserting said pages in said spring spine and slotted member; and removing said slotted member thereby releasing the spring and securing said pages in said spine.

5. The method of claim 4, further including the step of providing said spring clamp and said slotted member in the form of metal.

6. The method of claim 4, wherein said pages are secured to said spring clamp, spine and covers independent of external equipment.

7. A cost effective method for non-thermal and non-adhesive binding of previously bound or unbound pages into a book comprising the steps of: providing a hard or soft book cover that includes a spring spine secured to the length of the spine and which is held in an open position full length of said spring spine by a slotted member; inserting said pages in said spring spine and slotted member; and removing said slotted member thereby releasing the spring and securing said pages in said spine.

8. The method of claim 7, further including the step of providing said spring clamp and said slotted member in the form of metal.

9. The method of claim 7, wherein said pages are secured to said spring clamp, spine and covers independent of external equipment.

* * * * *